US012397211B2

(12) United States Patent
Schwyter et al.

(10) Patent No.: US 12,397,211 B2
(45) Date of Patent: Aug. 26, 2025

(54) GAME NET AND SHUTTLECOCK FOR USE THEREWITH

(71) Applicants: Raphael Oliver Schwyter, Toronto (CA); Steven Mueller, Clearwater, FL (US)

(72) Inventors: Raphael Oliver Schwyter, Toronto (CA); Steven Mueller, Clearwater, FL (US)

(73) Assignee: System Enterprises, LLC, Clearwater, FL (US)

( * ) Notice: Subject to any disclaimer, the term of this patent is extended or adjusted under 35 U.S.C. 154(b) by 773 days.

(21) Appl. No.: 17/681,881

(22) Filed: Feb. 28, 2022

(65) Prior Publication Data

US 2022/0176217 A1 Jun. 9, 2022

Related U.S. Application Data

(63) Continuation-in-part of application No. 16/935,340, filed on Jul. 22, 2020, now abandoned.

(60) Provisional application No. 62/885,215, filed on Aug. 10, 2019.

(51) Int. Cl.
*A63B 61/00* (2006.01)
*A63B 67/187* (2016.01)

(52) U.S. Cl.
CPC ..... *A63B 61/003* (2013.01); *A63B 67/187* (2016.01)

(58) Field of Classification Search
CPC ..... A63B 61/003; A63B 67/18; A63B 67/183; A63B 67/187; A63B 67/19; A63B 67/193; A63B 67/197
USPC ..... 473/492, 578, 579, 580, 586
See application file for complete search history.

(56) References Cited

U.S. PATENT DOCUMENTS 2,093,301 A * 9/1937 Bauer ..... A63B 67/187 29/592
2,116,304 A * 5/1938 Crespin ..... A63B 67/187 473/580
2,133,684 A * 10/1938 Colson ..... A63B 67/18 473/580
2,153,251 A * 4/1939 Hudson ..... A63B 67/19 473/580
2,217,032 A * 10/1940 Timpe ..... A63B 67/19 43/42.24
2,262,045 A * 11/1941 Pollitt ..... A63B 67/187 428/6
2,485,420 A * 10/1949 Timpe ..... A63B 67/187 473/580
2,613,935 A * 10/1952 Richards ..... A63B 67/187 473/580
D171,012 S * 12/1953 Sametz ..... D21/711
(Continued)

*Primary Examiner* — Joseph B Baldori
(74) *Attorney, Agent, or Firm* — Lewellyn Law, PLLC; Stephen Lewellyn

(57) ABSTRACT

A game system having a net and a shuttlecock for playing a game involving hitting the shuttlecock back-and-forth between players located on opposite sides of the net. The net is supported above a ground surface and has an opening formed therethrough to provide passage of the shuttlecock through the net when hit by one or more players located on opposite sides of the net. The shuttlecock has a plurality of flexible feather fins that are specifically configured and arranged to provide airspeed braking of the shuttlecock when in flight to control the speed and the distance that the shuttlecock may be hit.

9 Claims, 10 Drawing Sheets

(56) References Cited

U.S. PATENT DOCUMENTS 2,666,643 A * 1/1954 Miller ..... A63B 67/19 473/580
2,734,746 A * 2/1956 Sametz et al. ..... A63B 67/19 473/579
2,757,932 A * 8/1956 Shaw ..... A63B 67/197 446/400
2,828,966 A * 4/1958 Swartz ..... F42B 6/003 473/578
2,853,302 A * 9/1958 Wolf ..... A63B 67/187 D21/711
3,100,116 A * 8/1963 Fagan ..... A63B 67/18 473/579
3,752,479 A * 8/1973 Chung ..... A63B 67/18 473/580
4,101,128 A * 7/1978 Yellen ..... A63B 67/187 473/459
4,305,589 A * 12/1981 Popplewell ..... A63B 67/18 473/579
4,657,262 A * 4/1987 Buckland ..... A63B 67/19 473/580
4,813,686 A * 3/1989 Miranda ..... A63B 67/183 473/580
4,995,619 A * 2/1991 Hwang ..... A63B 67/187 446/397
5,066,017 A * 11/1991 Kurland ..... F42B 6/003 473/586
5,265,886 A * 11/1993 Hum ..... A63B 67/183 473/579
5,421,587 A * 6/1995 Mao-Huang ..... A63B 67/187 473/579
5,562,290 A * 10/1996 Wei ..... F21K 2/06 473/570
5,853,340 A * 12/1998 Willis ..... A63B 67/193 473/579
5,924,943 A * 7/1999 Sklar ..... A63B 67/193 473/579
7,429,223 B2 * 9/2008 Dovrat ..... A63B 63/00 473/476
8,105,185 B2 * 1/2012 Tanaka ..... A63B 67/193 473/579
8,585,518 B2 * 11/2013 Dai ..... A63B 67/187 473/580
8,992,355 B2 * 3/2015 Yoneyama ..... A63B 67/187 473/580
9,061,193 B2 * 6/2015 Dai ..... A63B 67/187
9,132,328 B1 * 9/2015 Daole ..... A63B 67/18
9,440,130 B2 * 9/2016 Dai ..... A63B 67/19
10,065,096 B2 * 9/2018 Chen ..... A63B 67/19
10,493,344 B1 * 12/2019 Mueller ..... A63B 1/00
10,576,346 B2 * 3/2020 Sakaguchi ..... A63B 67/19
10,814,196 B2 * 10/2020 Chen ..... A63B 67/19
11,130,035 B2 * 9/2021 Chen ..... A63B 67/19
11,759,688 B2 * 9/2023 Chen ..... A63B 67/187 473/580
2007/0225426 A1 * 9/2007 Li ..... C08L 51/06 524/504
2014/0155201 A1 * 6/2014 Yoneyama ..... A63B 67/19 473/580
2019/0053467 A1 * 2/2019 Foley ..... A63B 43/008
2021/0060400 A1 * 3/2021 Chen ..... A63B 67/19

* cited by examiner

GAME NET AND SHUTTLECOCK FOR USE THEREWITH

CROSS REFERENCE TO RELATED APPLICATIONS

This application is a continuation-in-part of U.S. patent application Ser. No. 16/935,340, filed Jul. 22, 2020, which claims the benefit of U.S. Provisional Application Ser. No. 62/885,2015, filed Aug. 10, 2019, the entirety of both are incorporated herein by reference.

FIELD OF THE INVENTION

The present invention relates generally to racket sport games and, more specifically, to an improved game net and shuttlecock.

BACKGROUND OF THE INVENTION

Games using balls or shuttlecocks that are hit by a paddles or rackets are known. These games may be played on a court with a net over which players hit a ball or a shuttlecock back-and-forth during game play, such as, for example, tennis and badminton. These games require a large area that can accommodate the net and the playing court and cannot be played in confined or small areas.

Shuttlecocks used in conjunction with these games are designed to allow the shuttlecock to fly long distances. The harder the shuttlecock is hit the faster and the further the shuttlecock will fly. A player can hit a shuttlecock so hard that the shuttlecock flies too fast and too far to be returned by an opposing player. Accordingly, games that use shuttlecocks conventionally also use courts that delineate boundaries (i.e., court lines on the playing surface) in which the shuttlecock must remain within for play. If a player hits the shuttlecock beyond the boundaries, the player is penalized.

While the existing games and shuttlecocks serve their respective objectives and requirements, they do not provide for a game that can be played in small areas and without boundary lines defining a court. Accordingly, there is a need, and a desire of a new game net and shuttlecock that can be played in small areas, including confined indoor spaces.

SUMMARY OF THE INVENTION

Accordingly, it is a general object of embodiments of the present invention to provide an improved and novel game net and an improved and novel shuttlecock that can be used in conjunction with the game net.

Another object of embodiments of the present invention is to provide a game net having a structure that restricts the area by which a shuttlecock can be hit from one side of the net to other side, thereby eliminating the need for a lined court. Particularly, the game net has a window or opening bounded along all sides by a net and through which the shuttlecock must be directed.

Another object of embodiments of the present invention is to provide a game net that can be used indoors or outdoors.

Another object of embodiments of the present invention is to provide a game net that is easy to setup.

Another object of the present invention is to provide an improved shuttlecock construction that self-limits its speed and flight distance. The shuttlecock construction is such that when it is struck, the shuttlecock spins about its axis and induces centrifugal forces on its tail feathers. The centrifugal forces acting on the tail feathers cause the tips of the feathers to bend outwardly inducing a braking action, which limits its speed and flight distance. The harder the shuttlecock is struck, the higher the centrifugal forces and thus the greater braking action.

The shuttlecock's self-limiting speed and flight distance design allows the shuttlecock to be used in smaller spaces and with game nets, such as the game net of embodiments of the present invention that does not use court boundaries for game play.

To achieve the foregoing and other objects of embodiments of the invention, in general, in one aspect, a game net is vertically supported by a frame and the net includes a centrally located opening or window through which a shuttlecock is directed. With this construction, players must direct the shuttlecock more accurately through the window with a higher degree of precision than what is required to pass an object over existing game nets.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature or a feature with similar functionality. In the drawings.

DETAILED DESCRIPTION OF THE INVENTION

With reference to the drawings, a new and improved game net embodying the principles and concepts of the present invention will be described.

Figure 1:
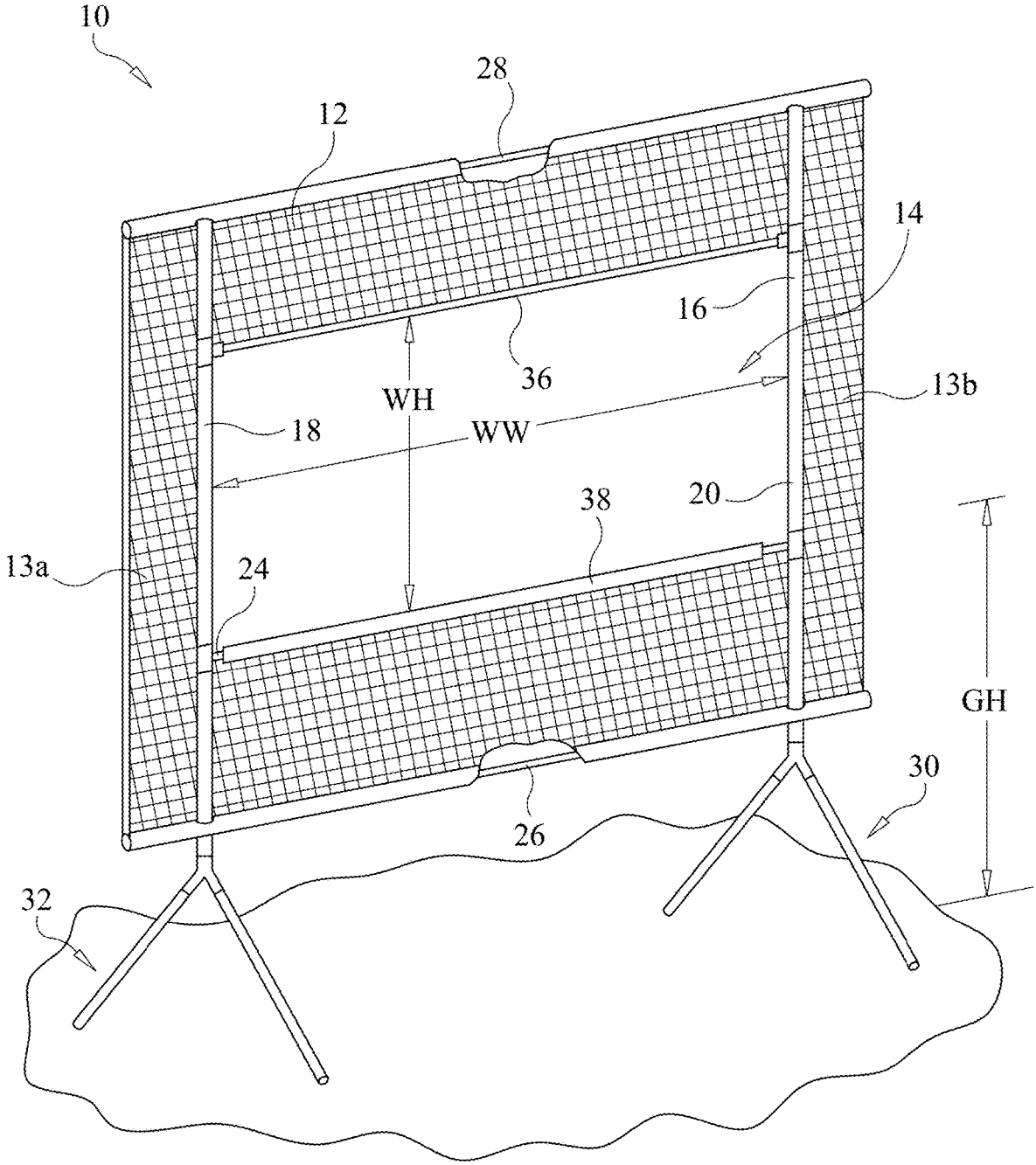
FIG. 1 is a perspective view of a game net constructed in accordance with an embodiment of the invention.

In FIG. 1, there is shown an exemplary embodiment of the game net of the invention, which is generally designated by reference number 10. In its preferred form, the game net 10 has a netting 12 forming a planar, vertically oriented barrier that defines an opening 14 through the barrier. The opening 14 is disposed, generally centrally in the netting such that the netting forms a wall or barrier around the opening. The opening 14 can be thought of like a window through the netting 12 that is surrounded by netting along each side of the opening.

Figure 3:
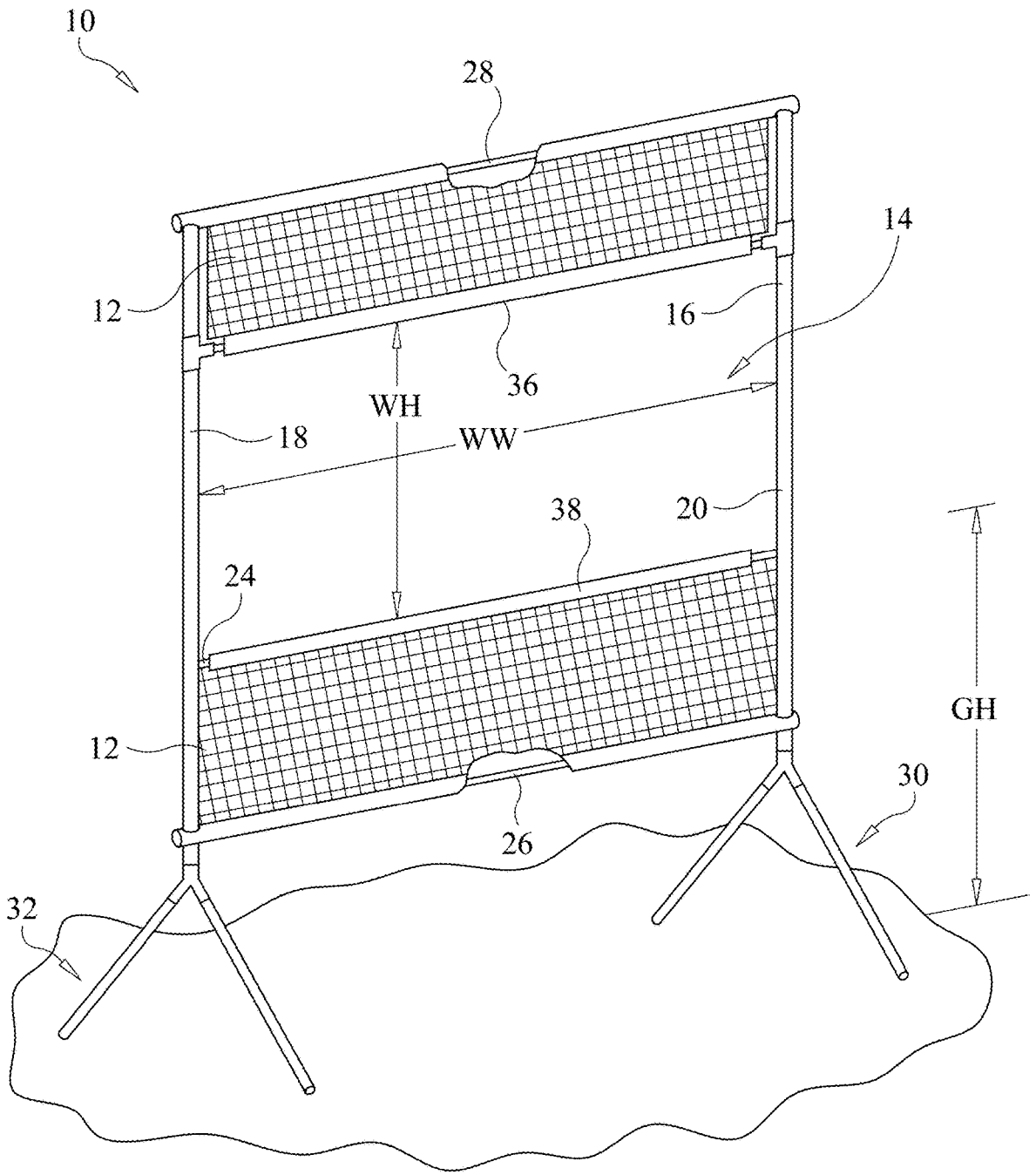
FIG. 3 is a perspective view of a game net constructed in accordance with an alternative embodiment of the invention.

Further, as depicted in this embodiment, the netting 12 includes side panels 13*a* and 13*b* that extend along the opposite, vertical sides of the opening 14. In an alternative arrangement, as seen in FIG. 3, netting 12 can be provided without the side panels 13*a* and 13*b*.

The netting 12 is attached to and supported by a frame 16 such that the netting is supported upon a ground surface and extends vertically upward therefrom, thereby providing the vertically oriented barrier. Netting 12 is attached to and supported by the frame 16 such that the netting maintains its shape. The frame 16 can include a pair of spaced apart vertical frame members 18 and 20. And can include a plurality of horizontal frame members 22, 24, 26, and 28 that are connected to and extend between the vertical frame members 18 and 20 at spaced vertical distances between one another. The frame 16 further includes a pair of ground engaging support leg assemblies 30 and 32.

It is important to understand the depicted frame 16 is representatively illustrated and the frame could take on various other constructions while remaining within the scope of the invention. For example, while not shown herein, the frame 16 can be collapsible to provide for easier storage and transport of the game net 10.

Further yet, the net 12 and the frame 16 can be constructed to permit adjusting the height of the opening or window 14 from the ground (GH), the dimensional width of the opening side-to-side (WW), and the dimensional height of the opening from top-to-bottom (WH).

Figure 2:
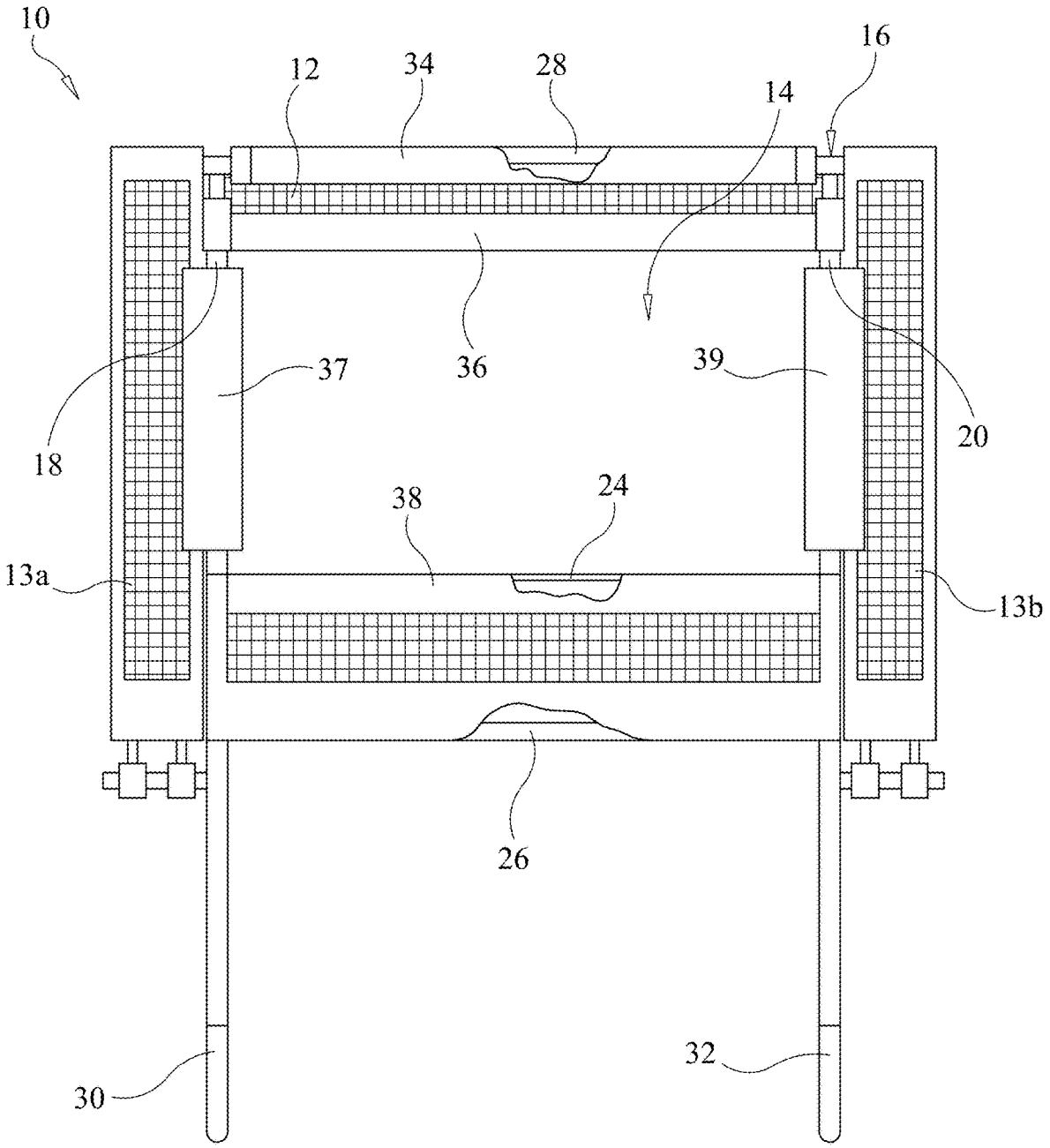
FIG. 2 is a front elevation view of a game net constructed in accordance with an embodiment of the invention.

Netting 12 may include sleeves, such as, for example sleeves 34, 36, and 38 through which sections of the frame 16 may be disposed or extend through to secure the netting 12 to frame. The netting 12 may include more or fewer sleeves than depicted here and as needed to attach the netting to the frame. An example of an alternative construction of the game net 10 and netting 12 is shown in FIG. 2, wherein netting further includes sleeves 37 and 39.

Additionally, other means such as, for example, straps, clasps, buttons, cords, etc. could also be used in connection with the sleeves or as alternative to the sleeves to secure the netting 12 to the frame 16.

Figure 4:
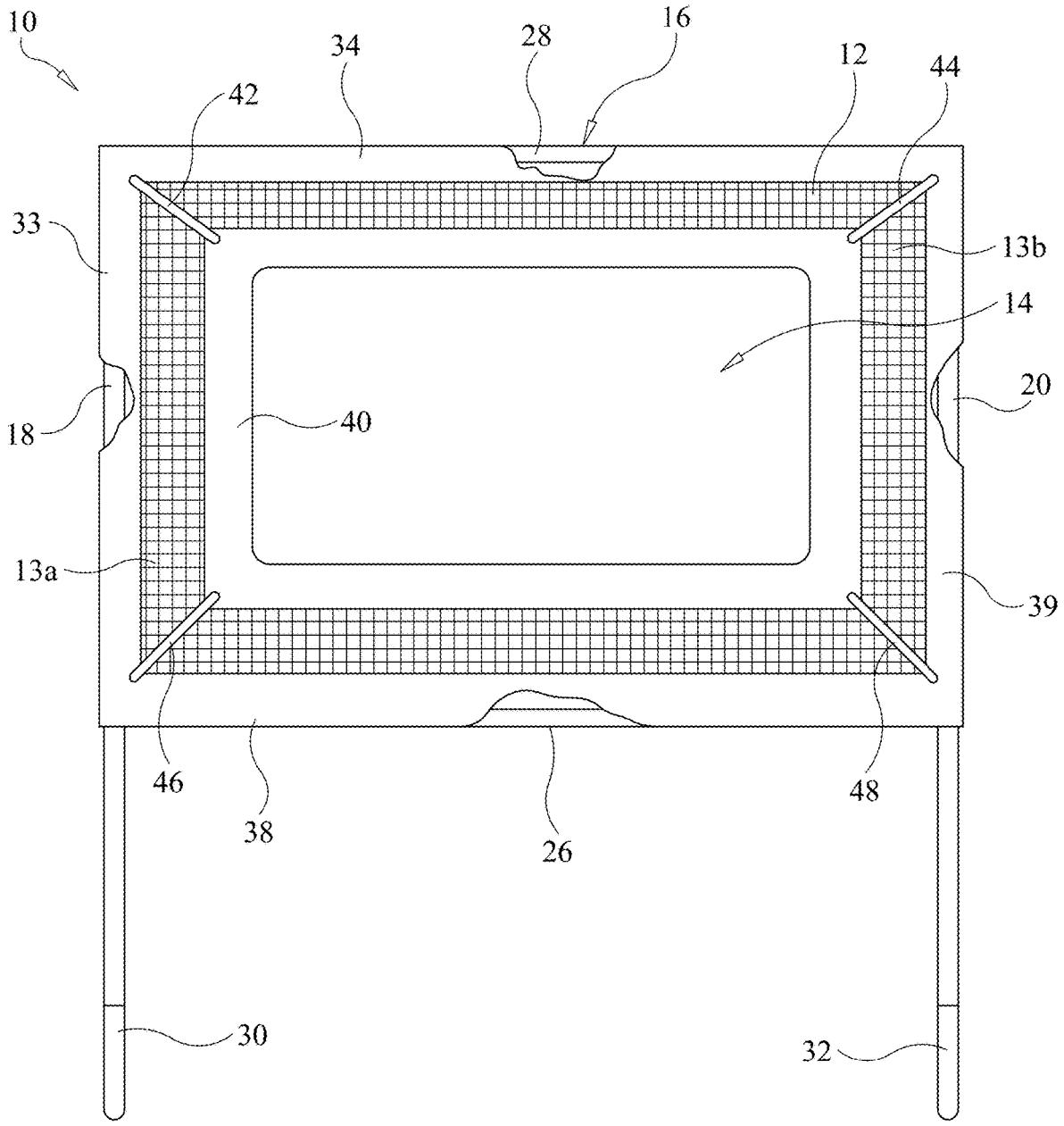
FIG. 4 is a front elevation view of a game net constructed in accordance with an embodiment of the invention.

In FIG. 4, there is shown an alternative construction of game net 10. As depicted here, the game net 10 has a similar construction to the game net shown in the prior figures. As shown here, a border 40 arranged it attached to the netting 12 around the opening 14. Border 40 serves several functions, including delineating the opening 14 and to provide support to the netting 12 around the opening. Border 40 could be colored with a bright color to give players a better visual identification of the opening 14.

As further shown here, a plurality of elastic cords 42-48 can be attached to the netting 12 to keep the netting pulled tight at the opening 14, keeping the opening fully open at its extents. As representatively shown, elastic cords 42-48 can each extend from a respective corner of the border to a corresponding corner of the netting 12, as shown. The elastic cords 42-48 could be arranged in different locations so long as the same purpose of keeping the opening 14 fully open is provided.

Figure 5:
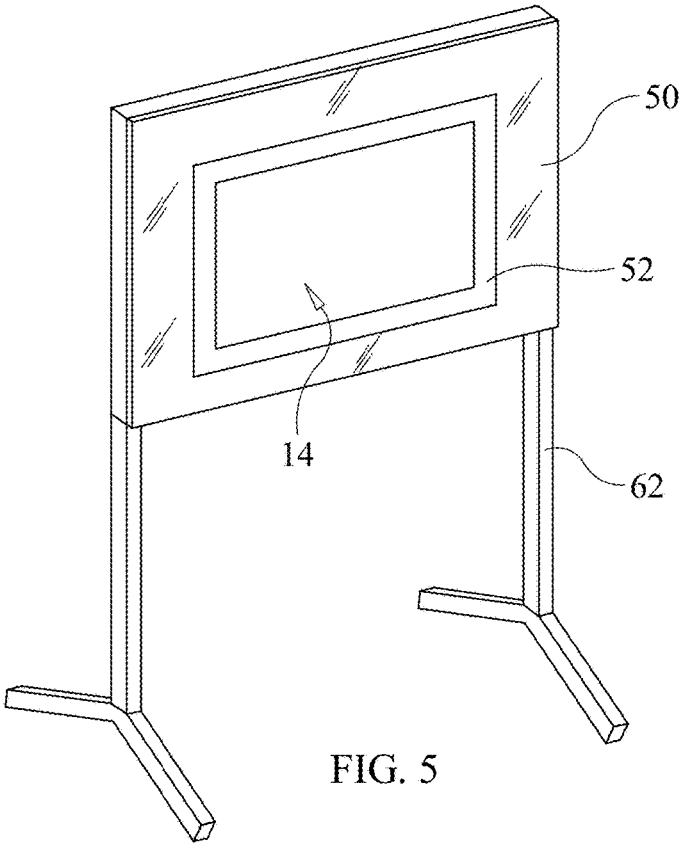
FIG. 5 is a perspective view of a game net constructed in accordance with an embodiment of the invention.
Figure 6:
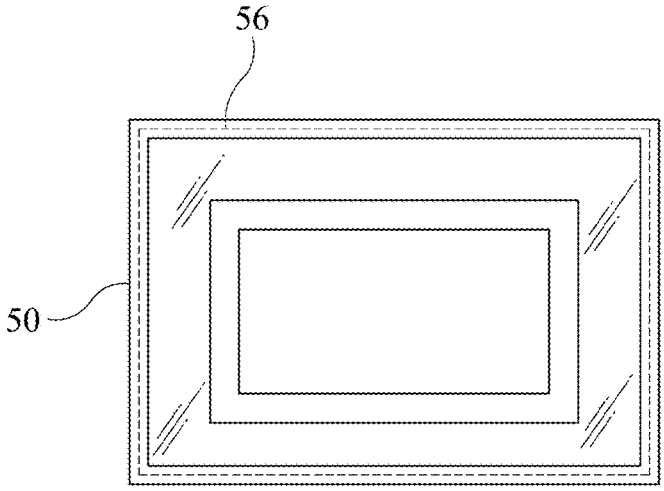
FIG. 6 is an elevation view of a game net constructed in accordance with an embodiment of the invention.
Figure 7:
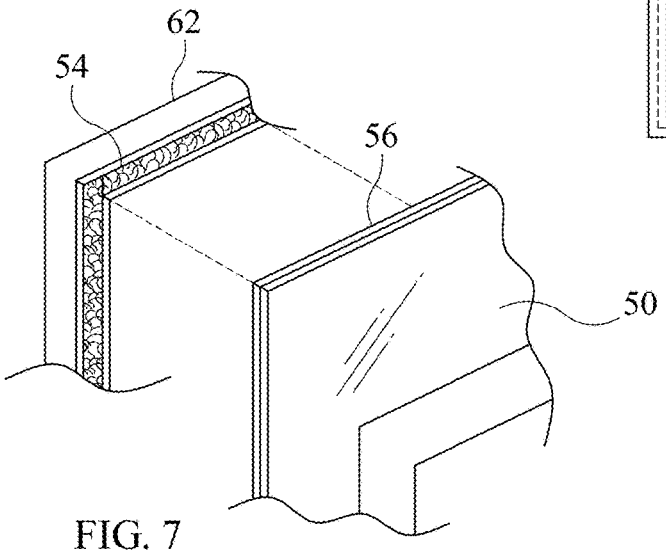
FIG. 7 is an enlarged, partial perspective view of a game net constructed in accordance with an embodiment of the invention.

In FIGS. 5-7, there is shown an alternative construction of game net 10. As depicted here, the game net 10 has a similar construction to the game net shown in the prior figures. However, in this embodiment, the netting 12 is replaced by panel 50 that is supported above a ground surface by attachment to frame 62, for example. Like the forgoing embodiment, panel 50 has the opening 14 and a border 52 disposed around the perimeter of the opening. Border 52 could be colored with a bright color to give players a better visual identification of the opening 14. Panel 50 can be removably attached to the frame by mechanical fasteners, such as, for example matting touch fasteners, wherein one half of the fastener 54 is disposed on the frame and the other half is 56 is disposed around the perimeter of the panel 50, along one broadside thereof.

Preferably, panel 50 is constructed of a transparent material, thereby allowing players located on opposite sides to see one another through the panel. In embodiments, it is contemplated that the panel could be created from a single piece of rigid, transparent plastic material. In other embodiments, it is contemplated that the panel could be created from a single piece of flexible, transparent plastic material, that could be rolled up for storage and unrolled for attachment to the frame 62.

Figure 8:
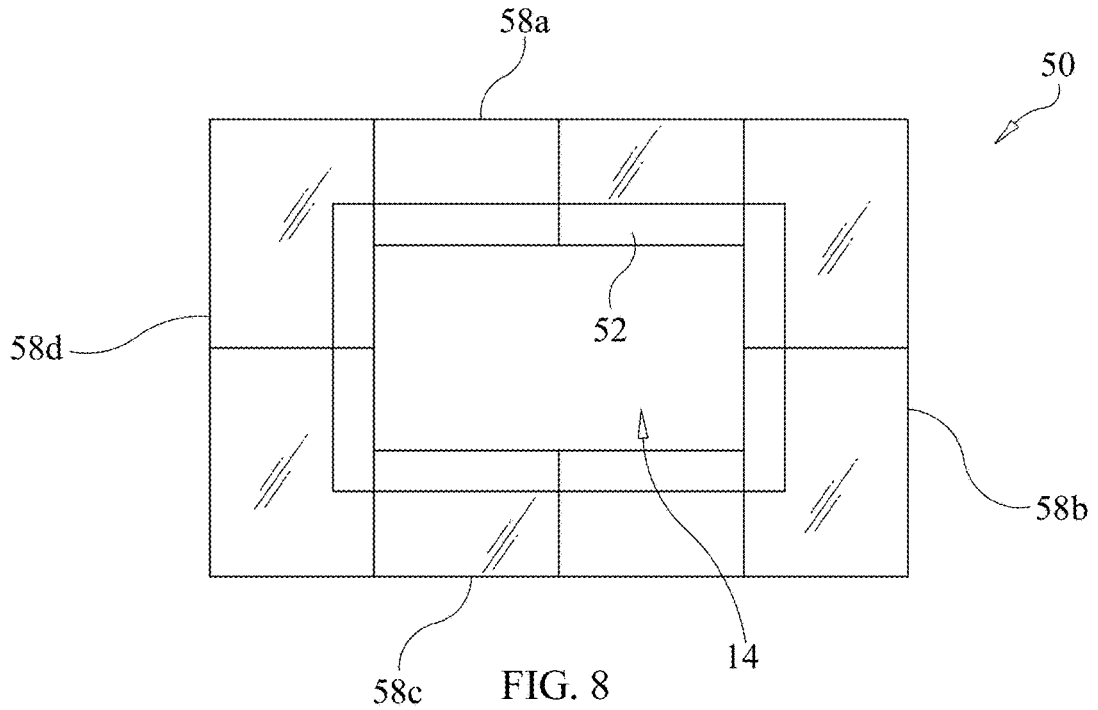
FIG. 8 is an elevation view of a game net constructed in accordance with an embodiment of the invention.
Figure 9:
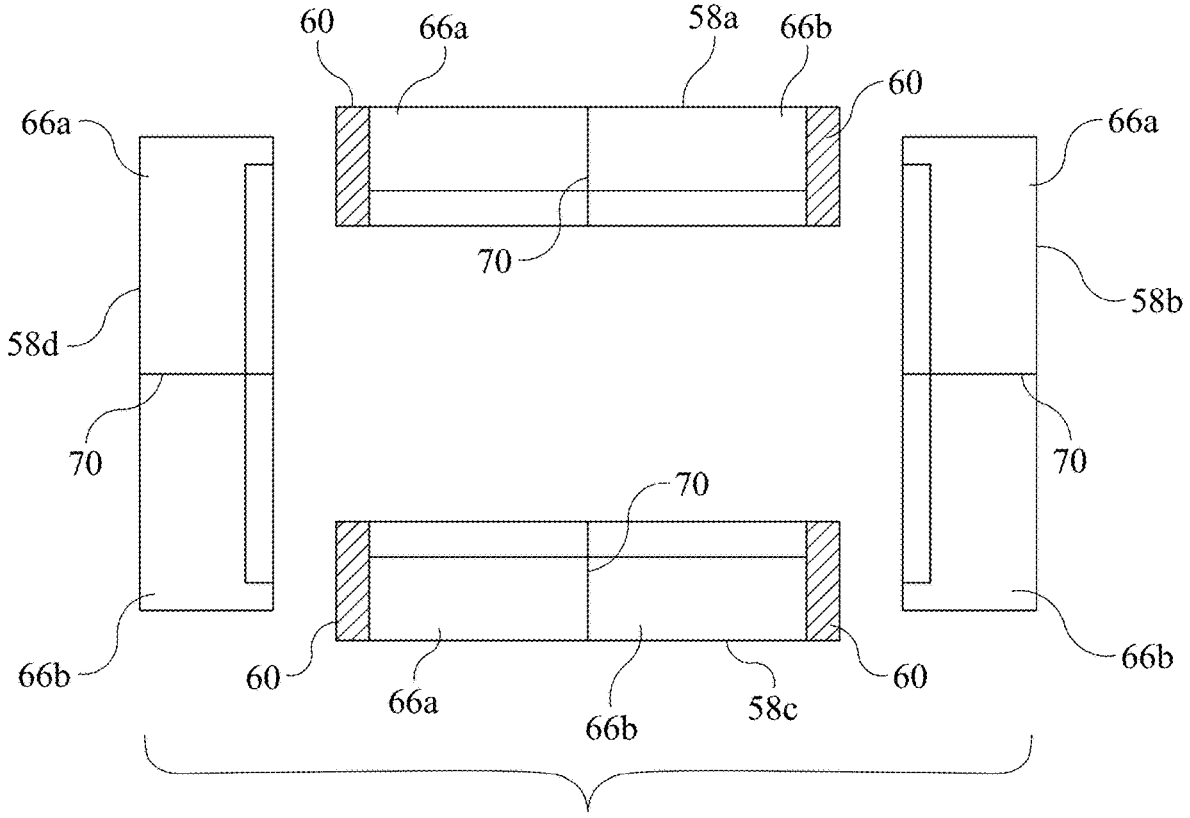
FIG. 9 is an exploded view of a game net constructed in accordance with an embodiment of the invention.
Figure 10:
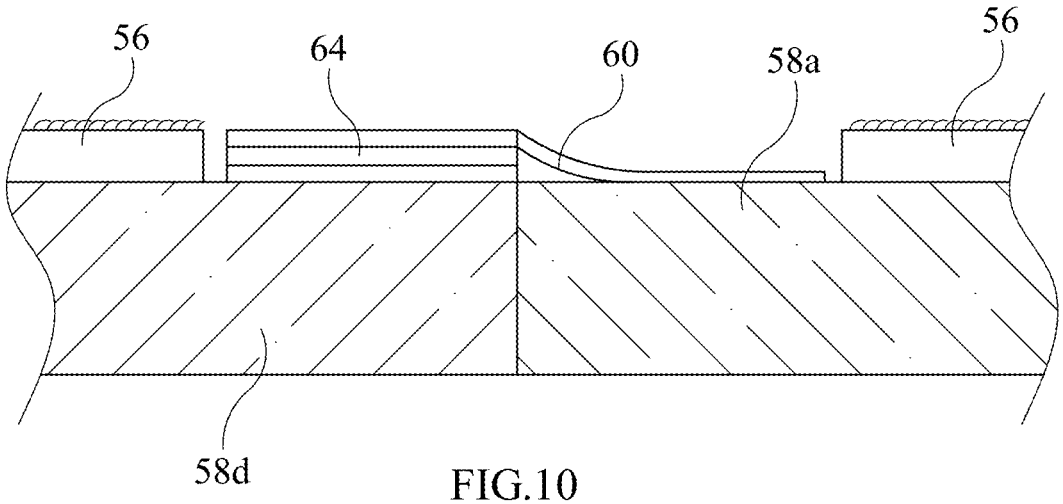
FIG. 10 is a cross-sectional view taken along line 10-10 in FIG. 8.

With reference to FIGS. 8 and 9, in embodiments, it is contemplated that the panel 50 could be constructed of individual panels 58*a*-58*d* that can be removably connected to create the panel 50. The individual panels 58*a*-58*d* would be constructed of rigid, transparent plastic material. With further reference to FIG. 10, in an embodiment, panels 58*a* and 58*c* could have tabs 60 located at opposite ends that removably secure to panels 58*b* and 58*d* to connect the panels together by a mechanical fastener, such as a touch fastener 64, for example.

Figure 11:
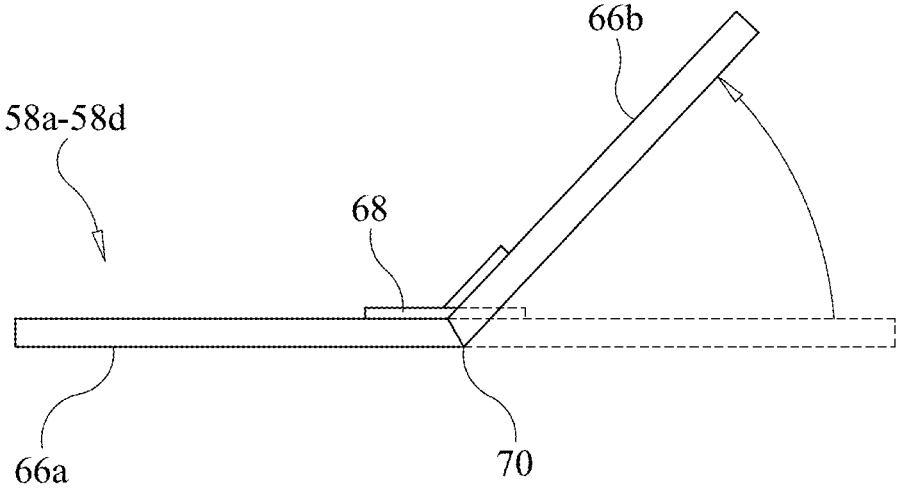
FIG. 11 is view of a panel of a game next constructed in accordance with an embodiment of the invention.

With further reference to FIG. 11, it is further contemplated that each panel 58*a*-58*d* could be constructed to fold in half to make storage and shipping easier. In such a construction, each panel 58*a*-58*d* could comprise two or more sections 66*a* and 66*b* that are joined by a flexible coupling 68 along fold joint 70 to fold in half.

Figure 12:
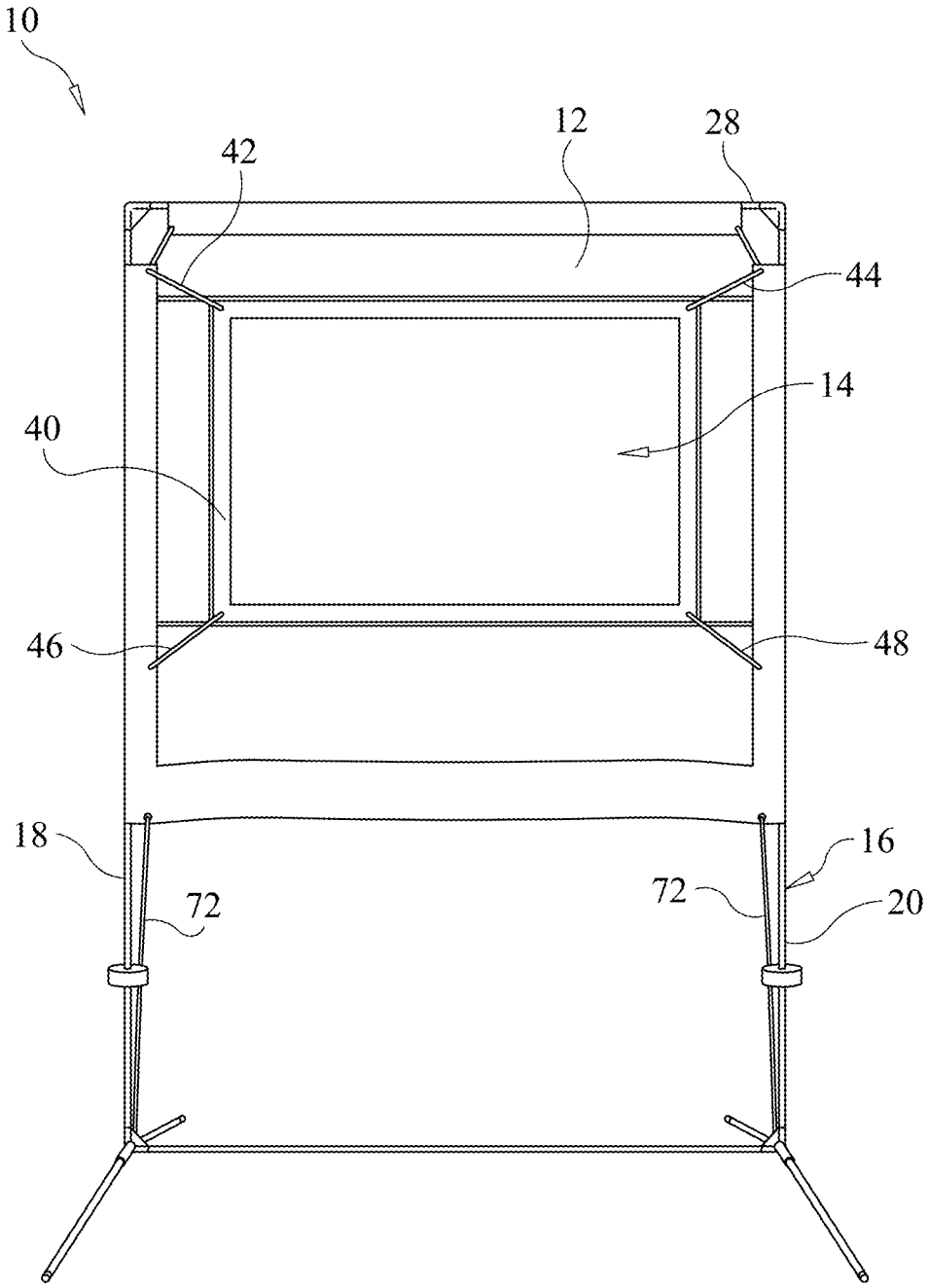
FIG. 12 is a front elevation view of a game net constructed in accordance with an embodiment of the invention.
Figure 13:
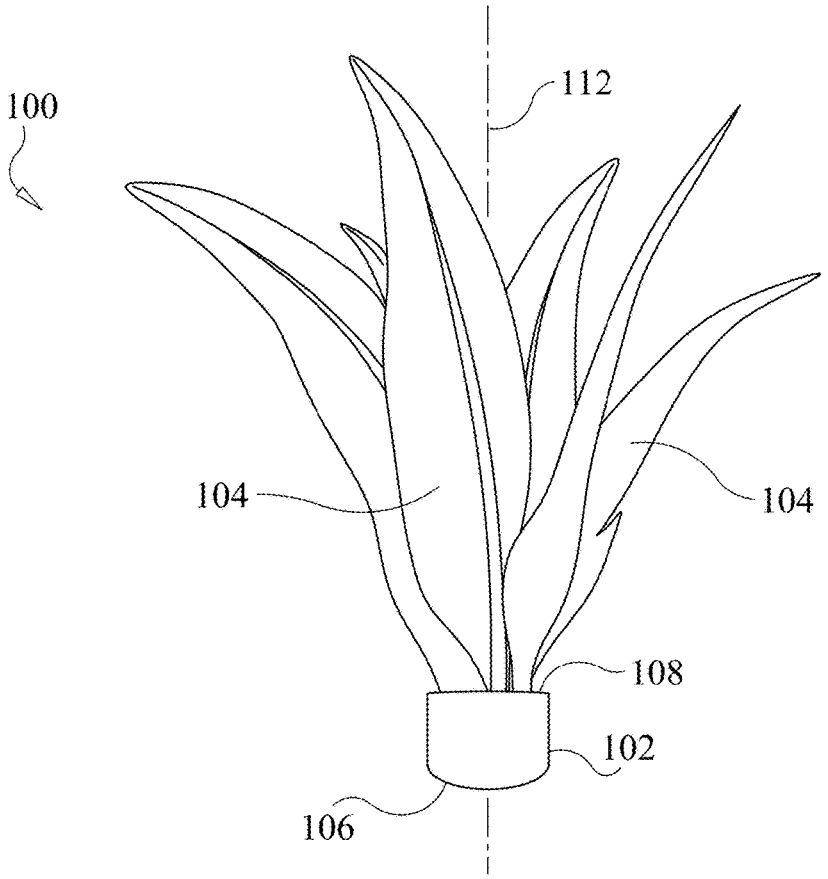
FIG. 13 is a is a front elevation view of a shuttlecock constructed in accordance with an embodiment of the invention.
Figure 14:
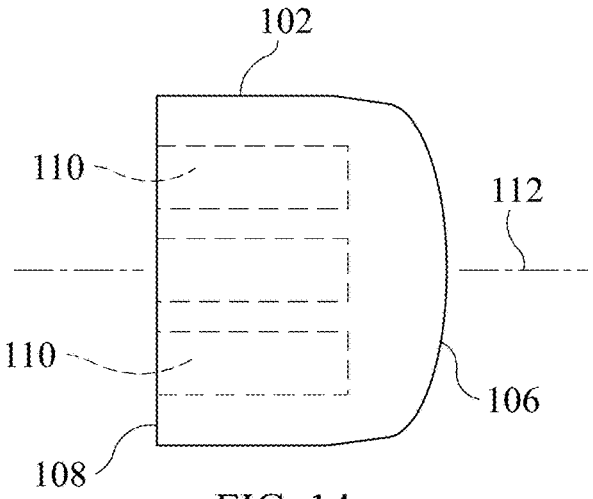
FIG. 14 is a side view of a nose cone of a shuttlecock constructed in accordance with an embodiment of the invention.
Figure 15:
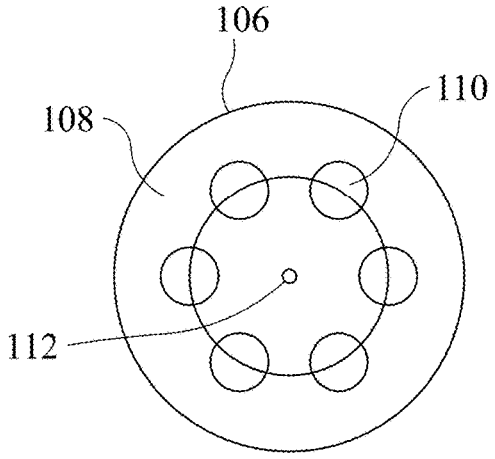
FIG. 15 is a top view of a nose cone of a shuttlecock constructed in accordance with an embodiment of the invention.

In FIG. 12 there is shown an alternative construction of game net 10. As depicted here, the game net 10 has a similar construction to the game net shown in the prior figures and, particularly, the game net shown in FIG. 4. Like reference numbers refer to the same or similar parts and thus a description of those element does not require repeating here. The construction depicted in FIG. 12 does not include the lower frame cross member 26 and further includes an elastic cord 72 attached to each bottom corner of the net 12 and to the bottom of the frame 16 to pull the net tight in a direction downwardly on the frame.

Game net 10 is particularly useful in facilitating game play without a lined court. This allows quick and simple setup of the game net 10. The construction further allows for both indoor and outdoor play.

Generally, in use, players would stand on opposite sides of the game net 10. The players would then, using paddles, hit a shuttlecock, for example, back and forth while attempting to pass the shuttlecock through the opening 14. Game play with net 10 is not limited to a shuttlecock, rather other objects, such as, a ball for example could be used. However, it is desired that the shuttlecock described herein below is used with the game net 10. Various game methods, rules, and scoring can be implemented in connection with the game net 10.

In FIGS. 13-16 there is illustrated a shuttlecock 100 that is constructed in accordance with an embodiment of the invention. The shuttlecock 100 is constructed, as described in further detail below, to have a controlled flight speed and flight distance making it desirable for use in connection with the foregoing described game net.

Shuttlecock 100 includes a nose cone 102 and a plurality of feather fins 104. The nose cone 102 is comprised of a solid component that can be made of a resilient plastic or hardened rubber. The nose cone has a rounded end 106 and an opposite end 108. Rounded end 106 is configured to be struck by a paddle or racket. Opposite end 108 is configured for the attachment of the feather fins 104 to the nose cone 102. Particularly, a plurality of blind bores 110 are formed through end 108 and extend axially into the body of the nose cone 102. The bores 110 are equally spaced circumferentially around the central axis 112 around the nose cone 102 at the same radial distance from the central axis.

As representatively shown, there are six bores 110 formed through end 108 of the nose cone 102 for receiving six feather fins 104, one in each bore. It should be noted, however, that the shuttlecock 100 is not limited to only six feather fins 104 as shown. Rather, the shuttlecock 100 could have additional or fewer fins so long as desired function described of the shuttlecock described herein is provided. For example, the shuttlecock could have between four and eight feather fins 104.

In an embodiment, feather fins 104 are natural wing feathers and are each from the same wing of a bird, such as, for example a goose. That is all the feather fins 104 are from either the right wing or from the left wing of the bird. Feathers from the left wing are never mixed with feathers from the right wing, this is critical to the desired operation of the shuttlecock 100. Additionally, the length of each feather fin 104, from the feather tip to the end of the calamus (quill) must be between 10 cm and 18 cm.

Figure 16:
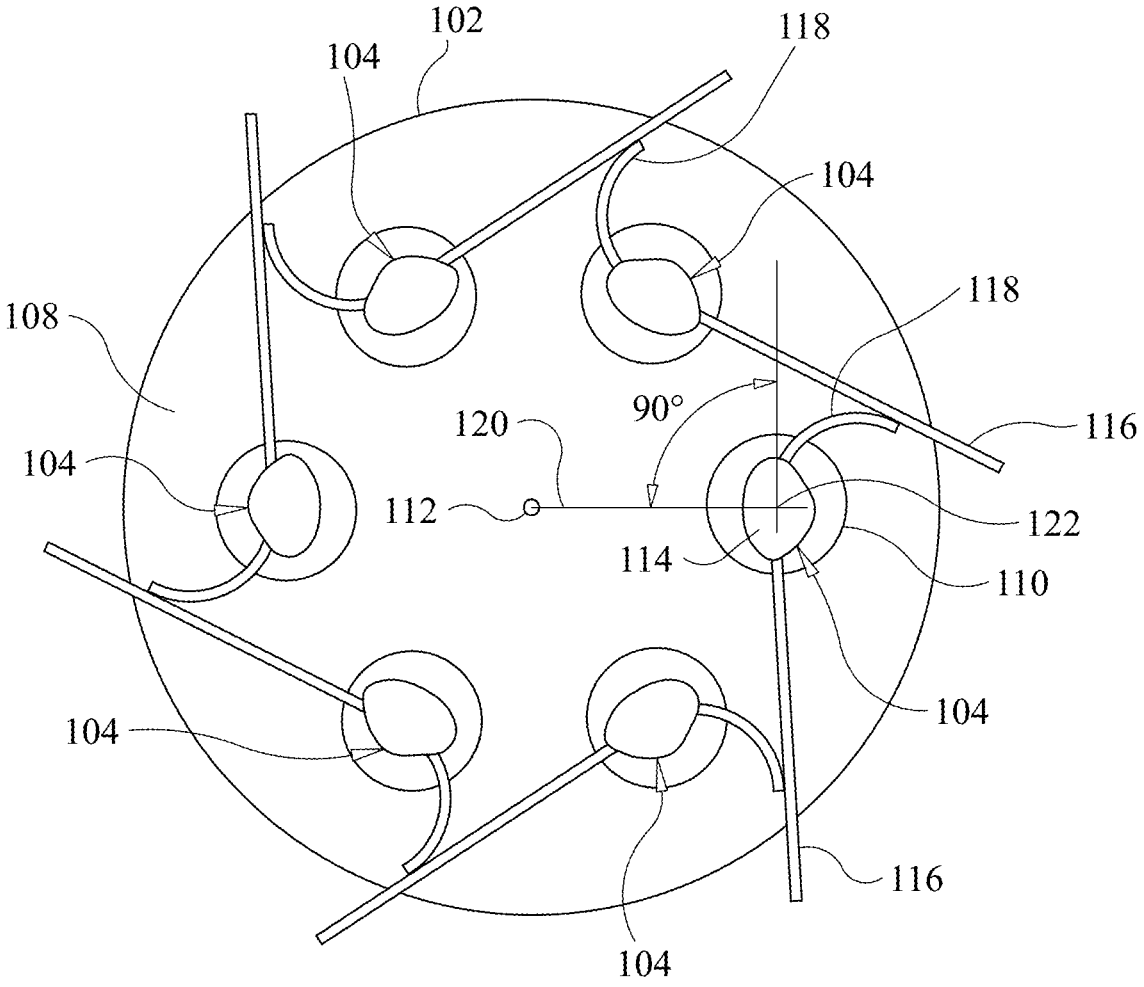
FIG. 16 is a top, diagrammatic view of a shuttlecock constructed in accordance with an embodiment of the invention.

The arrangement of the feather fins 104 on the nose cone 102 is also critical to the operation of the shuttlecock 100. Specifically, as best seen in FIG. 16, each feather fin 104 is positioned in its respective bore 110 with the feather shaft 114 in a rotated position such that the natural convex curvature of the inner vane 116 and the outer vane 118 are facing inwardly toward the axis 112. And further that the rotated position of the feather shaft 114 is such that the attachment points of the inner vane 116 and of the outer vane 118 with the feather shaft 114 are at a 90-degree angle relative to a radian line 120 extending from the axis 112 through the axis 122 of the feather shaft as measured at proximity to end 108. Further yet, the feather fins 104 are arranged such that the outer vane 118 of each feather fin is disposed on the inward side (in relation to axis 112) of the inner vane 116 of the immediately adjacent feather fin in an overlapping arrangement such that the leading edge 124 of the outer vane is facing in a direction outwardly (in relation to axis 112).

Further yet, unlike some existing shuttlecock constructions, none of the feather fins 104 of shuttlecock 100 are joined or otherwise connected along their lengths to an adjacent fin or any other fin attached to the nose cone 102. For the purpose herein, joined or connected means a physical link between fins that constrains relative movement between fins. To avoid uncertainty, for the purpose herein, a mere contact between surfaces of adjacent fins without a physical link that constrains relative movement between the fins is not considered joined or connected.

The foregoing described selection and arrangement of the feather fins 104 on the nose cone 112 provides the desired operational characteristics of the shuttlecock 100. Specifically, when end 106 of the shuttlecock 100 is struck by a paddle or racket, a spin about axis 112 is induced in the shuttlecock as it flies through the air. This spin imparts a centrifugal force on the feather fins 104, causing the fins to bend or flex outwardly away from axis 112. The outwardly bending of fins 104, during flight, increases the air drag on the shuttlecock 110, which brakes or slows the flight speed of the shuttlecock, and in turn limits the flight distance of the shuttlecock. In embodiments, the flight distance of the shuttlecock 100 is limited to about 18 feet.

This function overcomes the drawbacks of existing shuttlecocks that can be hit so hard by a player that the shuttlecock flies too fast and too far to be returned by an opposing player, and thus requiring lined courts for fair game play. Accordingly, shuttlecock 100 has the advantage of being played in a game without lined courts while maintain fair game play, which also makes the shuttlecock advantageous for play with the game net described herein.

While the foregoing description of the shuttlecock 100 is made in connection with its use with game net 10, one of ordinary skill in the art will readily appreciate that the shuttlecock can be used without the game net described herein and thus should not be limited to such use. Additionally, while natural feathers are desired as the feather fins, it is contemplated that manufactured or synthetic feathers that are created to mimic both the form and the physical properties of natural wing feathers could potentially be used and remain within the scope of the invention. Further, it is contemplated that the shuttlecock 100 could have fins 104 that are manufactured in a configuration that would impart the desired spin to the shuttlecock as explained above and have a flexibility allowing the fins to bend outwardly to provide the desired braking action on the shuttlecock, also described above.

While the invention has been particularly shown and described with respect to the illustrated embodiments thereof, it will be understood by those skilled in the art that the foregoing and other changes in form and details may be made therein without departing from the spirit and scope of the invention.

What is claimed is:

1. A shuttlecock, comprising:

a nose cone having a striking end, an attachment end, and a nose cone axis extending between the striking and attachment ends;

a plurality of flexible feather fins attached to and extending from the attachment end;

wherein the plurality of flexible feather fins are arranged and configured to impart a spin in the shuttlecock about the nose cone axis during flight of the shuttlecock through air when struck on the striking end;

wherein the plurality of flexible feather fins are further arranged and configured to bend outwardly in a direction away from the nose cone axis by centrifugal forces acting on the flexible feather fins created by the spin of the shuttlecock, and wherein the bending of the plurality of flexible feather fins causes an airspeed braking on the shuttlecock;

wherein each flexible feather fin has a shaft, an inner vane attached to the shaft, and an outer vane attached to the shaft, the inner and outer vanes each having a convex curvature;

wherein each flexible feather fin is arranged such that the convex curvature of the inner vane and of the outer vane are facing inwardly toward the nose cone axis and that the attachment points of the inner vane and of the outer vane with the shaft are at a 90-degree angle relative to a radian line extending from the nose cone axis through a longitudinal axis of the shaft; and wherein each feather fin is arranged such that the outer vane is disposed on an inward side of the inner vane of an immediately adjacent feather fin in an overlapping arrangement with a leading edge of the outer vane facing in an outward direction away from the nose cone axis, and wherein the inward side of the inner vane is a surface of the inner vane that faces toward the nose cone axis.

2. The shuttlecock of claim 1, wherein each flexible feather fin has a length between 10 and 18 cm.

3. The shuttlecock of claim 1, wherein the plurality of flexible feather fins are equally circumferentially spaced around the attachment end and at the same radial distance from the nose cone axis.

4. A shuttlecock, comprising:

a nose cone having a striking end, an attachment end, and a nose cone axis extending between the striking and attachment ends;

a plurality of flexible feather fins attached to and extending from the attachment end such that the flexible feather fins are equally circumferentially spaced around the attachment end and at the same radial distance from the nose cone axis, each feather fin has a total length of between 10 and 18 cm as measured from tip to tip before attachment to the attachment end, each feather fin has a shaft, an inner vane attached to the shaft, and an outer vane attached to the shaft, and the inner and outer vanes each having a convex curvature;

wherein the plurality of feather fins are arranged and configured to impart a spin in the shuttlecock about the nose cone axis during flight of the shuttlecock through air when struck on the striking end;

wherein the plurality of feather fins are further arranged and configured to bend outwardly in a direction away from the nose cone axis by centrifugal forces acting on the feather fins created by the spin of the shuttlecock, and wherein the bending of the plurality of feather fins causes an airspeed braking on the shuttlecock;

wherein each feather fin is arranged such that the convex curvature of the inner vane and of the outer vane are facing inwardly toward the nose cone axis and that the attachment points of the inner vane and of the outer vane with the shaft are at a 90-degree angle relative to a radian line extending from the nose cone axis through a longitudinal axis of the shaft; and wherein each feather fin is arranged such that the outer vane is disposed on an inward side of the inner vane of an immediately adjacent feather fin in an overlapping arrangement with a leading edge of the outer vane facing in an outward direction away from the nose cone axis, and wherein the inward side of the inner vane is a surface of the inner vane that faces toward the nose cone axis.

5. A game, comprising:

a net, the net supported above a ground surface in a vertical orientation, the net having an opening formed completely therethrough to allow an object to pass through the opening when hit by one or more players located on opposite sides of the net, the opening having a periphery and the net surrounding the periphery of the opening; and a shuttlecock, the shuttlecock comprising:

a nose cone having a striking end, an attachment end, and a nose cone axis extending between the striking and attachment ends a plurality of flexible feather fins attached to and extending from the attachment end;

wherein the flexible feather fins are arranged and configured to impart a spin in the shuttlecock about the nose cone axis during flight of the shuttlecock through air when struck on the striking end;

wherein the flexible feather fins are further arranged and configured to bend outwardly in a direction away from the nose cone axis by centrifugal forces acting on the feather fins created by the spin of the shuttlecock, and wherein the bending of the flexible feather fins causes an airspeed braking on the shuttlecock;

each feather fin has a shaft, an inner vane attached to the shaft, and an outer vane attached to the shaft, the inner and outer vanes each having a convex curvature;

each feather fin is arranged such that the convex curvature of the inner vane and of the outer vane are facing inwardly and that the attachment points of the inner vane and of the outer vane with the shaft are at a 90-degree angle relative to a radian line extending from the nose cone axis through a longitudinal axis of the shaft; and wherein each feather fin is arranged such that the outer vane is disposed on an inward side of the inner vane of an immediately adjacent feather fin in an overlapping arrangement with a leading edge of the outer vane facing in an outward direction away from the nose cone axis, and wherein the inward side of the inner vane is a surface of the inner vane that faces toward the nose cone axis.

6. The game of claim 5, further comprising a border attached to the net and extending around the periphery of the opening, the border providing support to the net around the opening.

7. The game net of claim 5, further comprising:

a frame supported on the ground surface and wherein the net is attached to the frame for supporting the net above the ground surface.

8. The game net of claim 5, wherein the frame includes one or more vertical frame members, the vertical frame members extending in a generally vertically upward direction when the frame is disposed in an upright orientation on the ground surface.

9. The game net of claim 5, wherein the opening is rectangular shaped.

* * * * *